US005738551A

United States Patent [19]

Matsuoka

[11] Patent Number: 5,738,551

[45] Date of Patent: Apr. 14, 1998

[54] RETAINING ELECTRICAL CONNECTOR

[75] Inventor: Hiroyuki Matsuoka, Yokkaichi, Japan

[73] Assignee: Sumitomo Wiring Systems, Ltd., Japan

[21] Appl. No.: 800,334

[22] Filed: Feb. 14, 1997

[30] Foreign Application Priority Data

Feb. 14, 1996 [JP] Japan ..... 8-026355

[51] Int. Cl.[6] ..... H01R 13/436

[52] U.S. Cl. ..... 439/752

[58] Field of Search ..... 439/752, 595

[56] References Cited

U.S. PATENT DOCUMENTS

| | | | |
|---|---|---|---|
| 4,867,712 | 9/1989 | Kato et al. | 439/752 |
| 5,516,308 | 5/1996 | Yamanashi | 439/752 |
| 5,609,503 | 3/1997 | Tsuji et al. | 439/752 |
| 5,630,736 | 5/1997 | Yagi et al. | 439/752 |
| 5,662,501 | 9/1997 | Yagi et al. | 439/752 |

*Primary Examiner*—Gary F. Paumen

*Attorney, Agent, or Firm*—Jordan B. Bierman; Bierman, Muserlian and Lucas

[57] ABSTRACT

An electrical connector having a plurality of cavities extending therethrough. A retainer is inserted into the housing in its holding position, wherein insertion and withdrawal of an electrical terminal is permitted. The terminal is inserted and inclined receiving planes guide the terminal toward the center of the cavity, even in the case of misalignment. The retainer is provided with end walls which are inserted into recesses in the housing and the height of these recesses above the base of the terminal is less than the corresponding height of the terminal. This prevents the terminal from inadvertently entering the recess. As an alternative, the end walls can be extended below the base so that the advantages of larger walls can be obtained, without increasing the height thereof above the base.

6 Claims, 7 Drawing Sheets

RETAINING ELECTRICAL CONNECTOR

This application claims the benefit of the priority of Japanese Application 8-26355, filed Feb. 14, 1996.

The present Invention is directed to an electrical connector having a retainer, adapted to be attached thereto, which prevents a terminal inserted therein from being withdrawn. The Invention also relates to an improvement in recesses in the end walls of the retainer, whereby the terminal, in case of misalignment, is properly oriented.

BACKGROUND OF THE INVENTION

Prior art connectors of the general type to which the present Invention is directed are represented by FIGS. 11 and 12 hereof. Connector housing 1 comprises a plurality of cavities 2 adapted to receive terminals 3 which are provided with stabilizers 3A.

Retainer 4 consists of a generally planar base having end walls 5. Each of the end walls carries holding projection 5A which is adapted to engage holding detent 6 when the retainer is in its holding position. The base also carries blocking parts 4A and locking projections 7. When retainer 4 is in its locked position, projections 7 engage the upper surface of the floor of housing 1.

However, when the retainer is in its holding position, end walls 5 project into cavities 2. As a result, when terminal 3 is inserted into cavity 2 with retainer 4 in this position, there is a danger that terminal 3 catches on end walls 5 if it is out of line in any way. If this occurs, it prevents smooth insertion thereof. When the operation is performed by an automatic machine, such deviations are like to occur and, therefore, a device which will prevent terminal 3 from catching end walls 5 is useful.

SUMMARY OF THE INVENTION

Therefore, it is an object of the present Invention to provide a retainer which will prevent the terminal from catching the end walls as it is being inserted into the cavity. In particular, it is a feature of the present Invention that receiving planes are located on the end walls. They are angled so that, as the terminal is inserted, it is directed inwardly in a direction transverse to that of the cavities; therefore, even if the terminal is misaligned, it will enter the cavity smoothly and without difficulty.

The connector housing is provided with recesses which are adapted to receive the end walls of the retainer. However, these recesses are specifically made smaller than the corresponding dimension of the terminal in at least one dimension. Preferably, the height of the recess is less than the height of the terminal. This being so, it is impossible for the terminal to accidentally enter the recess when the retainer is in the holding position.

In a particularly preferred form of the Invention, the recesses extend vertically from a height less than that of the corresponding terminal to a point below the base of the retainer. Thus, since the terminal slides on the base, the height of the recess above the base is less than the height of the terminal. At the same time, since the recess also extends below the base, it is possible to have higher end walls which aid in the design of the device.

BRIEF DESCRIPTION OF THE DRAWINGS

In the accompanying drawings, constituting a part hereof, and in which like reference characters indicate like parts.

DETAILED DESCRIPTION OF THE INVENTION

Figure 1:
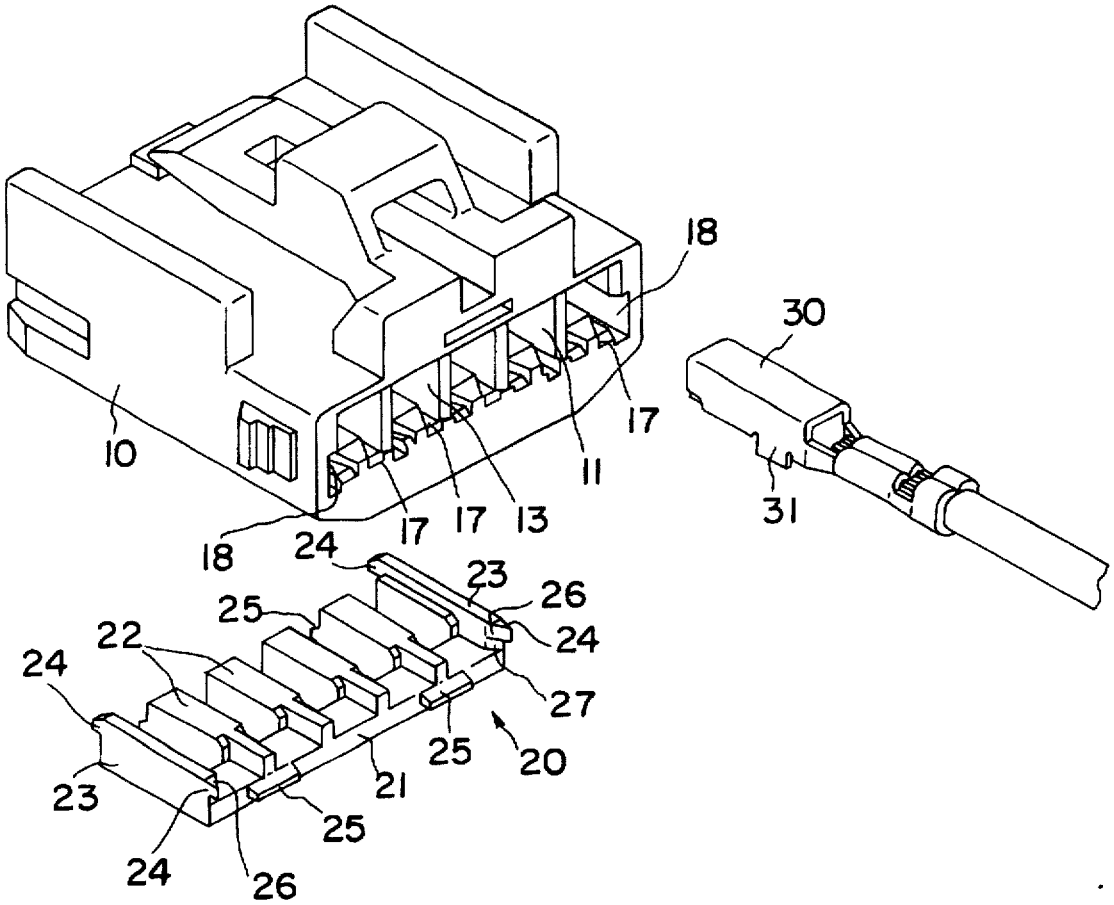
FIG. 1 is a perspective view showing the connector housing, retainer, and terminal.
Figure 2:
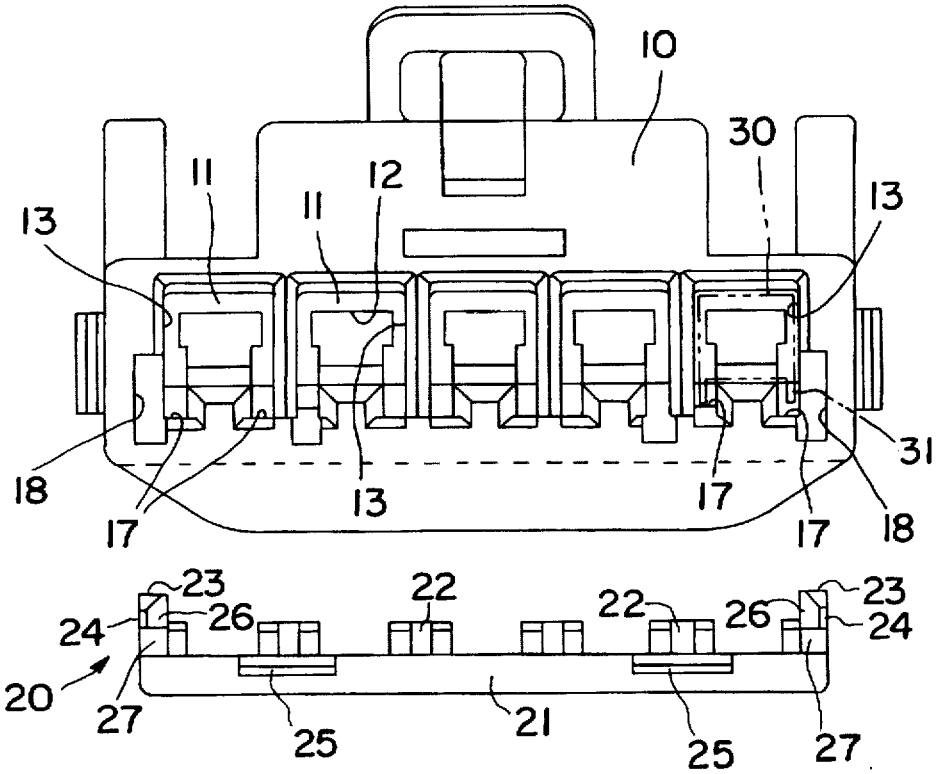
FIG. 2 is a view from the rear of the housing showing the housing and the unattached retainer.
Figure 3:
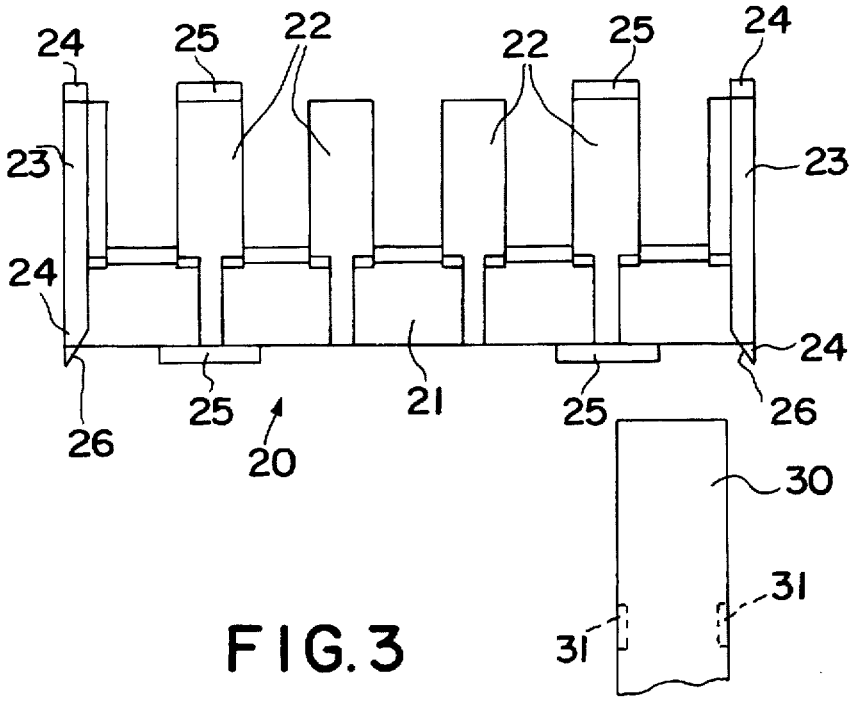
FIG. 3 is a plan view of the retainer and terminal.

Referring to FIGS. 1 to 7, connector housing 10 is provided with a plurality of cavities 11, each having inlet 13 and front opening 12, adapted to receive terminal 30 having stabilizers 31. Terminal 30 is guided by stabilizers 31 sliding in tracks 17.

Retainer 20 consists of base 21 with end walls 23 and holding blocks 22 mounted thereon. End walls 23 carry holding projections 24 and base 21 is provided with locking projections 25. Rear holding projections 24 include receiving plane 26 and receiving surface 27.

Figure 4:
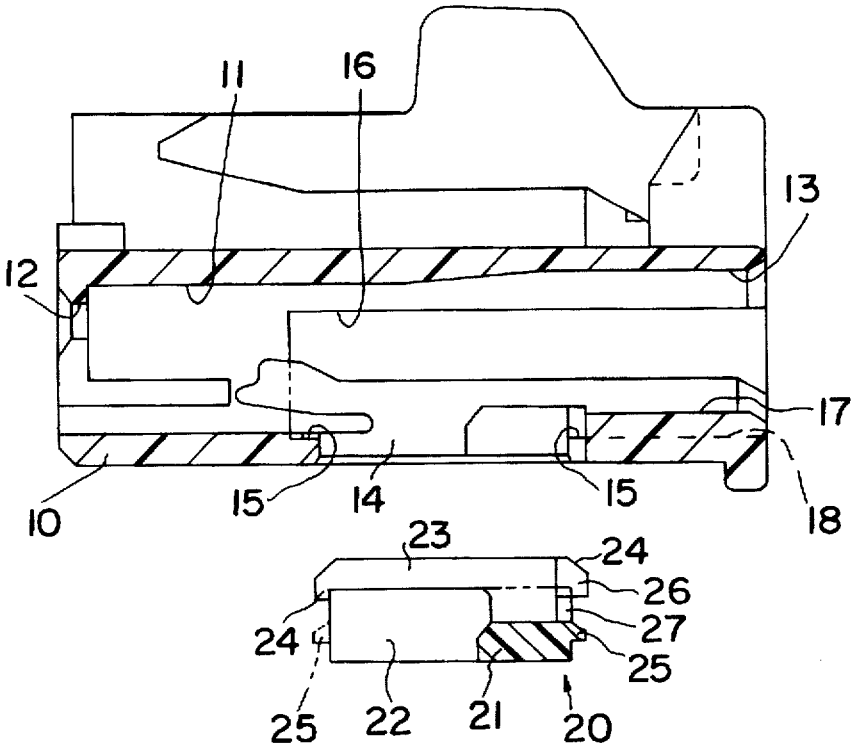
FIG. 4 is a schematic section through the center of FIG. 2.
Figure 5:
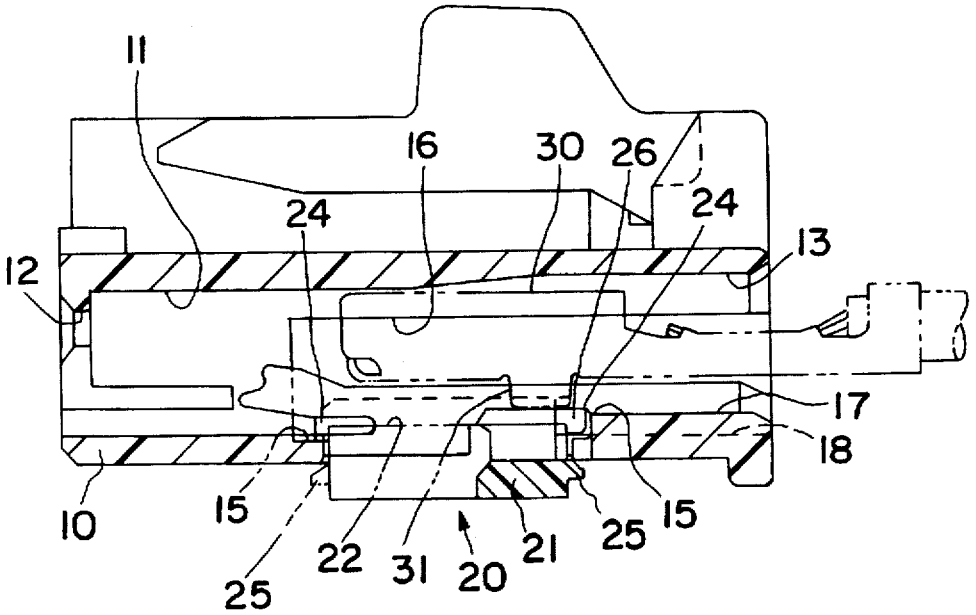
FIG. 5 is a view similar to that of FIG. 4 with the retainer in its holding position.
Figure 6:
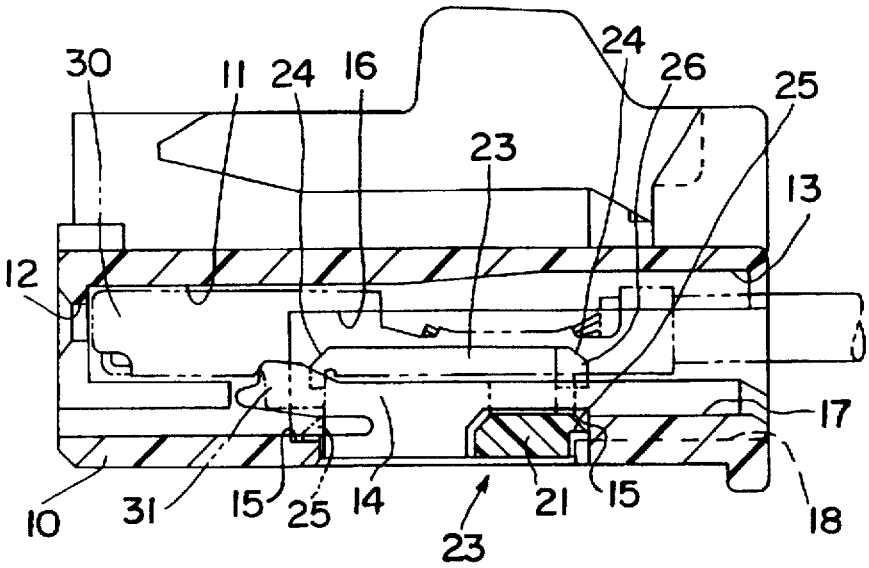
FIG. 6 is a view similar to that of FIG. 5 with the retainer in its locked position.
Figure 7:
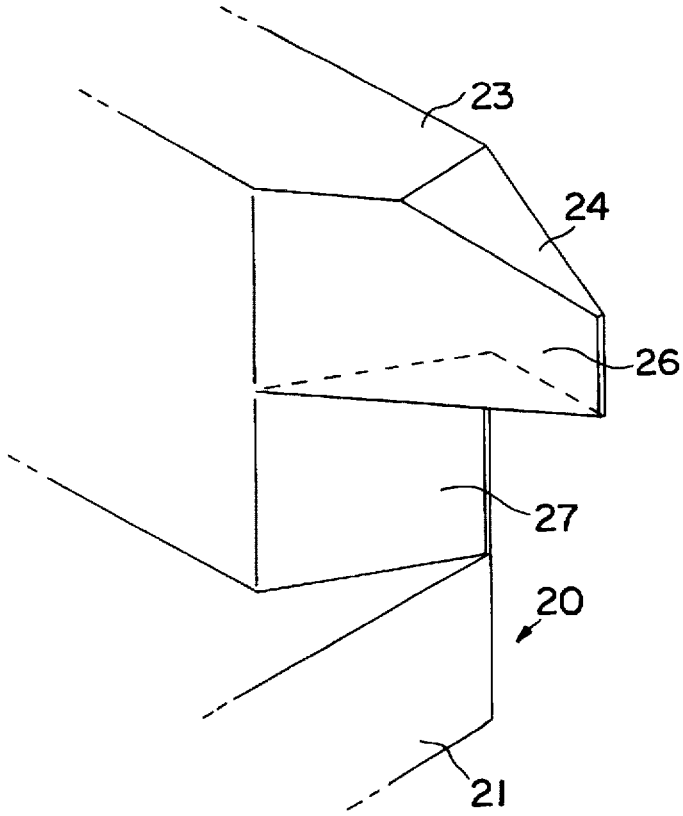
FIG. 7 is an enlarged fragmentary view of a portion of an end wall of the retainer.

FIGS. 4 to 6 show the assembly of the device. Retainer 20 is inserted through access 14 into its holding position as shown in FIG. 5. Holding projections 24 engage detent 15 in order to keep retainer 20 in position. Terminal 30 is inserted into cavity 11, with stabilizers 31 riding in tracks 17. Receiving planes 26 and receiving surfaces 27 guide terminal 30 toward the center of cavity 11 so as to prevent catching or snagging of terminal 30 on any interior portion of housing 10. Recesses 18 are provided on the interior surface of the outer sides of connector housing 10 and end walls 23 enter therein.

When terminal 30 has been fully inserted into cavity 11, retainer 20 is moved further inward through access 14 into its locked position, as can best be seen in FIG. 6. Locking projections 25 engage detent 15 in order to secure retainer 20 in this position.

Escape parts 16 are formed in the interior walls between adjacent cavities 11. Holding blocks 22 fit therein and extend on either side into the adjacent cavities. Thus, the substantially flat front surfaces of holding blocks 22 bear against terminals 30 and prevent their withdrawal.

Figure 8:
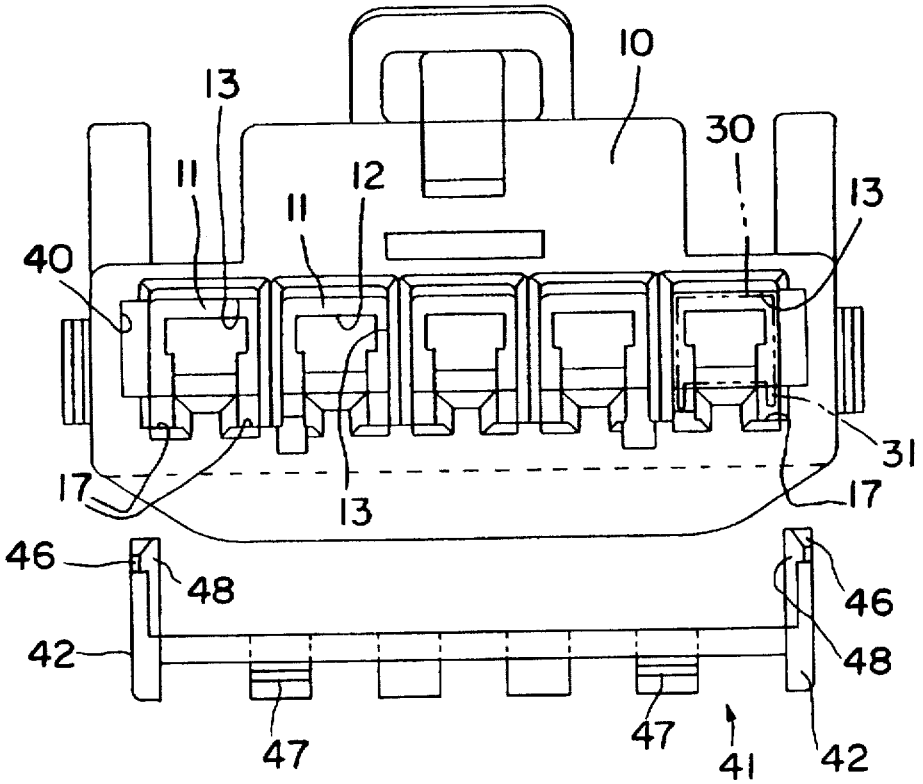
FIG. 8 is a view similar to that of FIG. 2 of another embodiment of the present Invention.
Figure 9:
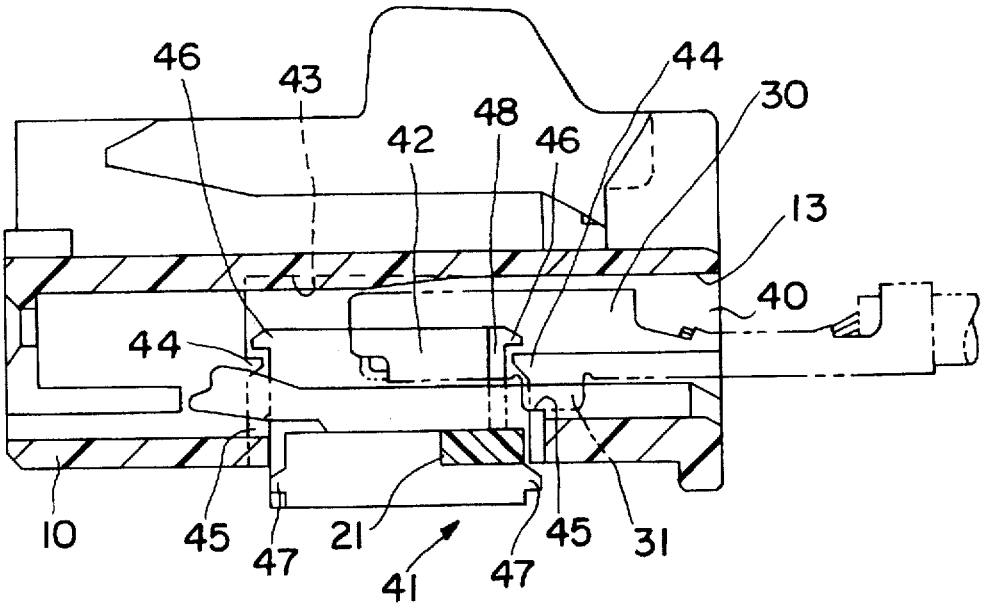
FIG. 9 is a view similar to that of FIG. 5 of the embodiment of FIG. 8.
Figure 10:
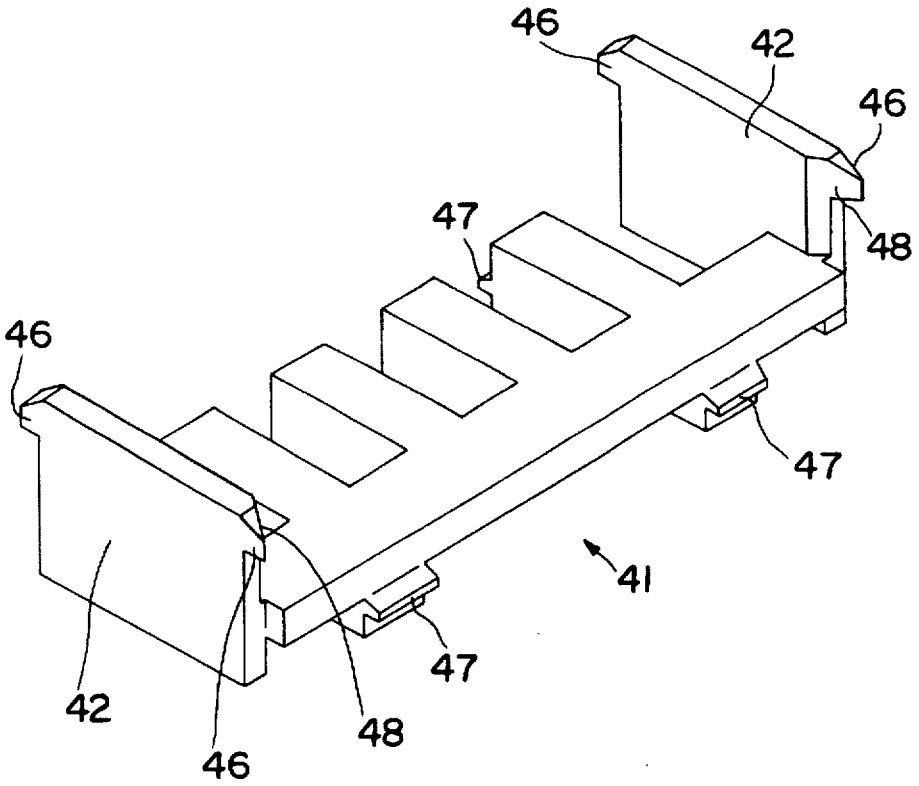
FIG. 10 is an enlarged perspective view of the retainer of FIG. 8.
Figure 11:
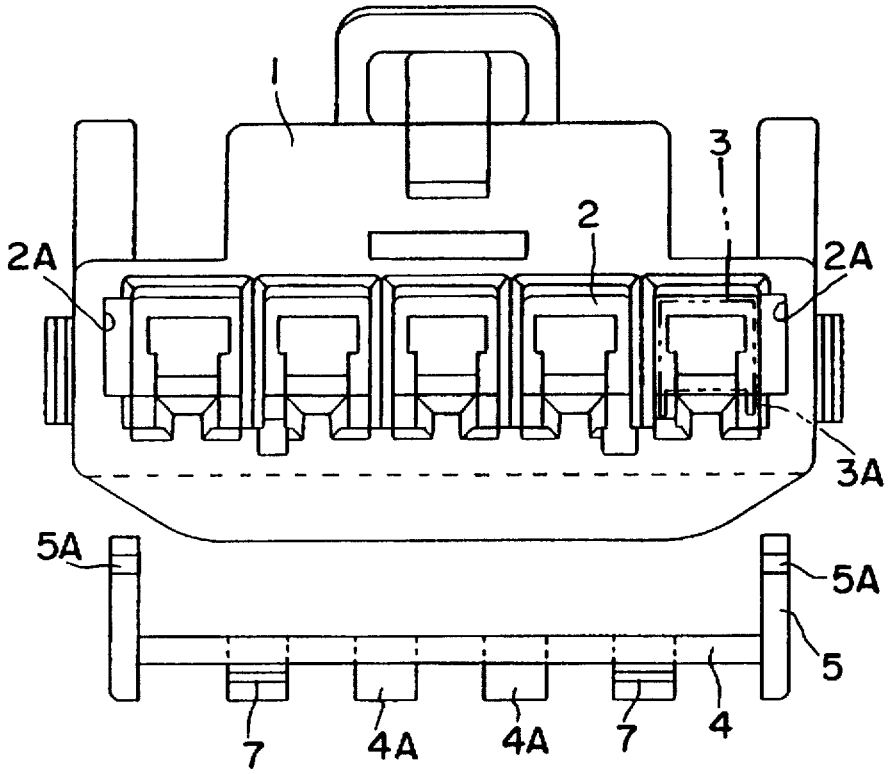
FIG. 11 PRIOR ART
FIG. 11 is a view, similar to that of FIG. 2 of the prior art device.
Figure 12:
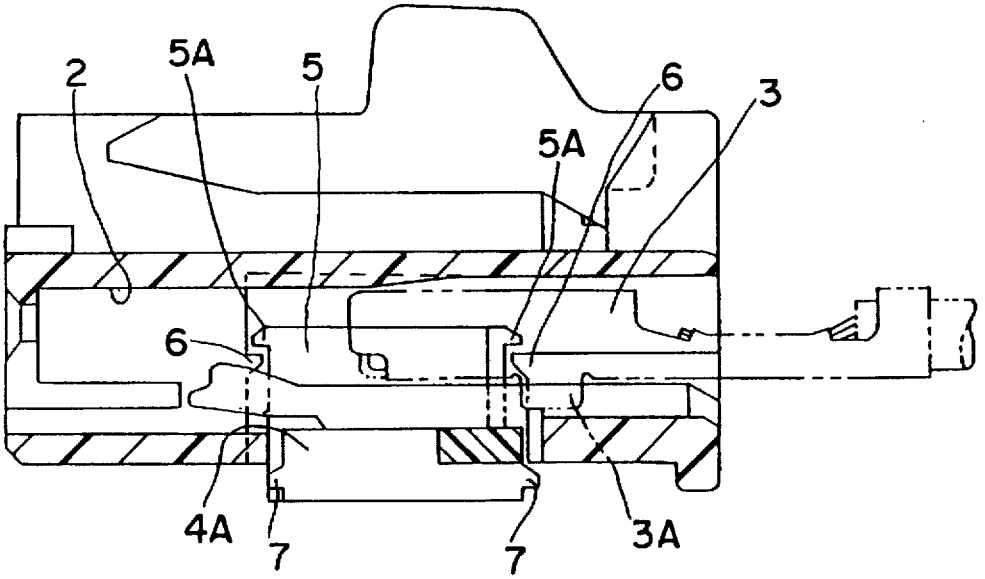
FIG. 12 PRIOR ART
FIG. 12 is a view similar to that of FIG. 5 of the prior art device of FIG. 11.

Another embodiment of the present Invention is shown in FIGS. 8 to 10. Many of the elements of this embodiment are the same as in the first embodiment and, therefore, need not be described for a second time. Retainer 41 is provided with end walls 42 which carry holding projections 46 and receiving plane 48. Locking projections 47 are mounted on the base of retainer 41. Retainer 41 is shown in its holding position in FIG. 9. Holding projections 46 engage holding detents 44, thereby maintaining retainer 41 in its holding position. Terminal 30 is inserted into cavity 11 and retainer 41 is moved further into housing 10 so that locking projections 47 engage locking detent 45. The squared off ends of the holding blocks bear against the rear of terminals 30 and thereby prevent them from being withdrawn. As in the first embodiment, receiving plane 48 guides terminals 30 into the center of cavities 11.

In a preferred form of the Invention, locking projections 25 and holding projections 24 are vertically separated by a distance slightly less than the thickness of the floor of cavity 11. In this way, as can be seen from FIG. 5, detent 15 is sandwiched between holding projections 24 and locking projections 25. It is, therefore, quite secure.

Thus, by virtue of the present Invention, it is possible to introduce the terminals into their respective cavities smoothly, even if misalignment occurs. The receiving planes and surfaces direct and affirmatively guide the terminals as they slide into the cavity, even when this operation is carried out by automatic machine. Moreover, the provision of recesses having heights less than those of the terminals prevents inadvertent entry therein. Finally, by extending the recesses below the base, additional stability can be obtained while the height to which the terminals have access remains less than the height of the terminals themselves.

Although a limited number of specific embodiments of the present Invention have been expressly described, it is, nonetheless, to be broadly construed and not to be limited except by the character of the claims appended hereto.

What we claim is:

1. An electrical connector comprising a housing having a plurality of cavities, each of said cavities extending through said housing in an insertion direction from an inlet, into which a terminal is to be inserted, to a front opening, into which a mating terminal to be inserted, a retainer, adapted for insertion into said housing in a retaining direction perpendicular to said insertion direction, said retainer having a holding position, engaging said housing and wherein insertion and withdrawal of said terminal is not prevented, and a locked position wherein a respective holding block on said retainer extends into each of said cavities and prevents withdrawal of the respective terminal from said cavity, said retainer having a pair of substantially planar end walls extending parallel to said insertion direction, each of said walls having a front extremity facing said front opening and a rear extremity facing said inlet, one holding projection on said rear extremity and another holding projection on said front extremity, said one projection and said other projection each engaging a detent on said housing when said retainer is in said holding position, said one projection having a receiving plane which inclines inwardly transverse to said cavities at a first angle in said insertion direction.

2. The electrical connector of claim 1 wherein said retainer comprises a planar base extending between said end walls below each said holding projection and carrying each said holding block, a locking projection on said base and adapted to engage a respective one of said detents when said retainer is in said locked position.

3. The electrical connector of claim 1 comprising an interior wall between adjacent said cavities, and a side of said housing constituting an exterior wall of one of said cavities adjacent thereto, a recess in said exterior wall opening into the cavity adjacent thereto, said recess having a dimension which is less than a corresponding dimension of said terminal, whereby said terminal is prevented from entering said recess.

4. The electrical connector of claim 4 wherein said dimension is a height of the top of said recess from said base.

5. The electrical connector of claim 4 wherein said recess extends below said base.

6. The electrical connector of claim 1 wherein said retainer comprises a planar base extending between said end walls below said holding projection and carrying each said holding block, a receiving surface on each of said end walls between said holding projections and said base, said surface being inclined inwardly at a second angle in said insertion direction, said first angle being greater than said second angle.

* * * * *